US010112738B2

(12) United States Patent
McCarthy

(10) Patent No.: US 10,112,738 B2
(45) Date of Patent: Oct. 30, 2018

(54) POURER DEVICE

(71) Applicant: Paul John McCarthy, Port Curtis (AU)

(72) Inventor: Paul John McCarthy, Port Curtis (AU)

( * ) Notice: Subject to any disclaimer, the term of this patent is extended or adjusted under 35 U.S.C. 154(b) by 0 days.

(21) Appl. No.: 15/202,488

(22) Filed: Jul. 5, 2016

(65) Prior Publication Data

US 2017/0008674 A1 Jan. 12, 2017

(51) Int. Cl.

| | |
|---|---|
| ***B65D 25/48*** | (2006.01) |
| ***B65D 23/12*** | (2006.01) |
| ***B65D 23/06*** | (2006.01) |
| *B65D 47/06* | (2006.01) |

(52) U.S. Cl.

CPC ..... *B65D 23/065* (2013.01); *B65D 23/12* (2013.01); *B65D 25/48* (2013.01); *B65D 47/06* (2013.01)

(58) Field of Classification Search

CPC ..... B65D 23/065; B65D 23/12; B65D 25/48; B65D 47/06

See application file for complete search history.

(56) References Cited

U.S. PATENT DOCUMENTS 483,670 A * 10/1892 Garwood ..... B65D 25/48 215/390
1,447,117 A * 2/1923 Balison ..... B65D 47/06 215/235
3,154,227 A * 10/1964 Anderson ..... A47J 36/14 215/386
3,330,449 A * 7/1967 Bloomfield ..... A47J 36/14 222/475
3,463,366 A * 8/1969 Spencer ..... B65D 25/48 222/570
3,800,988 A * 4/1974 Karlen ..... A47G 19/12 222/475.1
3,853,249 A * 12/1974 Weir, Jr. ..... B65D 25/48 222/570
3,961,732 A * 6/1976 Roberts ..... B44D 3/12 222/570
4,078,700 A * 3/1978 Hidding ..... B65D 47/123 222/109
4,129,236 A * 12/1978 Wrycraft ..... B65D 47/14 220/320
4,299,340 A * 11/1981 Hrytzak ..... B44D 3/12 222/189.07
4,573,615 A 3/1986 Marti
4,637,530 A * 1/1987 Jiang ..... B65D 25/42 222/564
4,702,395 A * 10/1987 Nitsch ..... B44D 3/12 220/318
4,907,714 A * 3/1990 Gatz ..... B44D 3/12 220/698
5,755,354 A 5/1998 Lang
(Continued)

*Primary Examiner* — Frederick C Nicolas
(74) *Attorney, Agent, or Firm* — Andrew W. Chu; Craft Chu PLLC

(57) ABSTRACT

A pourer device for mounting to a mouth portion of bottles includes a mount portion and a guide chute. The guide chute includes a generally channel shaped body having a wider proximal entry portion adjacent the bottle neck and a main portion which converges to a narrower distal portion. The mount portion includes two generally half ring portions which allows the device to be mounted to the neck of any bottle and be removable therefrom and mounted to another bottle as needed.

18 Claims, 5 Drawing Sheets

(56) References Cited

U.S. PATENT DOCUMENTS

| | | | | | |
|---|---|---|---|---|---|
| 5,853,107 | A * | 12/1998 | Giwojna | B44D 3/128 | 220/733 |
| 5,893,489 | A * | 4/1999 | Giarrante | B44D 3/127 | 220/254.8 |
| D484,801 | S | 1/2004 | Pierce | | |
| 6,997,360 | B2 * | 2/2006 | Cohn | A47G 19/145 | 220/719 |
| D705,598 | S | 5/2014 | Prokop | | |
| 9,631,382 | B2 * | 4/2017 | Murphy | E01C 23/0973 | |
| 2012/0168467 | A1 * | 7/2012 | Murphy | E01C 23/0973 | 222/465.1 |
| 2014/0319187 | A1 * | 10/2014 | McGee | B65D 25/48 | 222/570 |

* cited by examiner

POURER DEVICE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a pourer device.

2. Description of Related Art Including Information Disclosed Under 37 CFR 1.97 and 37 CFR 1.98.

The present invention seeks to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY OF THE INVENTION

According to a first aspect, the present invention provides a pourer device for a bottle having a neck which defines a bottle opening, the pourer device comprising:

a mount portion for detachable attachment to an external surface of the bottle, and a guide chute mounted to the mount portion, the guide chute disposed in use to receive liquid flow from the bottle opening, the guide chute adapted to shape the liquid flow from the bottle opening into a narrower flow.

In a preferred embodiment, the mount portion is adapted for mounting to the neck of the bottle.

Preferably, the mount portion is adapted for installation to a mouth portion of the bottle.

Preferably, the guide chute comprises a generally channel shaped or funnel shaped body.

Preferably, the guide chute comprises a wide entry portion and a main portion which converges to a narrow distal portion.

Preferably, the main portion includes a central section with side walls extending upwardly from side edges thereof to define the channel shaped body.

Preferably, the entry portion is angled upwardly relative to the main portion.

Preferably, the entry portion positions the main portion at an angle of about 45° in use.

Preferably, the entry portion includes a curved edge which substantially matches the curve of the bottle neck.

Preferably, the guide chute comprises a pivot mount at a lower surface thereof which is attached to the mount portion.

Preferably, the pivot mount allows the guide chute to be moved from a storage configuration to an in-use configuration.

Preferably, the pivot mount locks the guide chute in the in-use configuration.

Preferably, the mount portion comprises two generally half ring portions, having one end thereof attached to the pivot mount and a second end thereof attachable to each other, with a midsection therebetween disposed on opposite sides of the bottle neck.

Preferably, the midsections are curved.

Preferably, the mount portion comprises a quick mountable clip.

Preferably, the mount portion comprises resilient members.

Preferably, the mount portion comprises sealing means for sealing with the bottle.

Preferably, the in-use angle between the mount portion and the guide chute is adjustable.

Other aspects of the invention are also disclosed.

BRIEF DESCRIPTION OF THE SEVERAL VIEWS OF THE DRAWINGS

Notwithstanding any other forms which may fall within the scope of the present invention, preferred embodiments of the present invention will now be described, by way of examples only, with reference to the accompanying drawings.

DETAILED DESCRIPTION OF THE INVENTION

Figure 1:
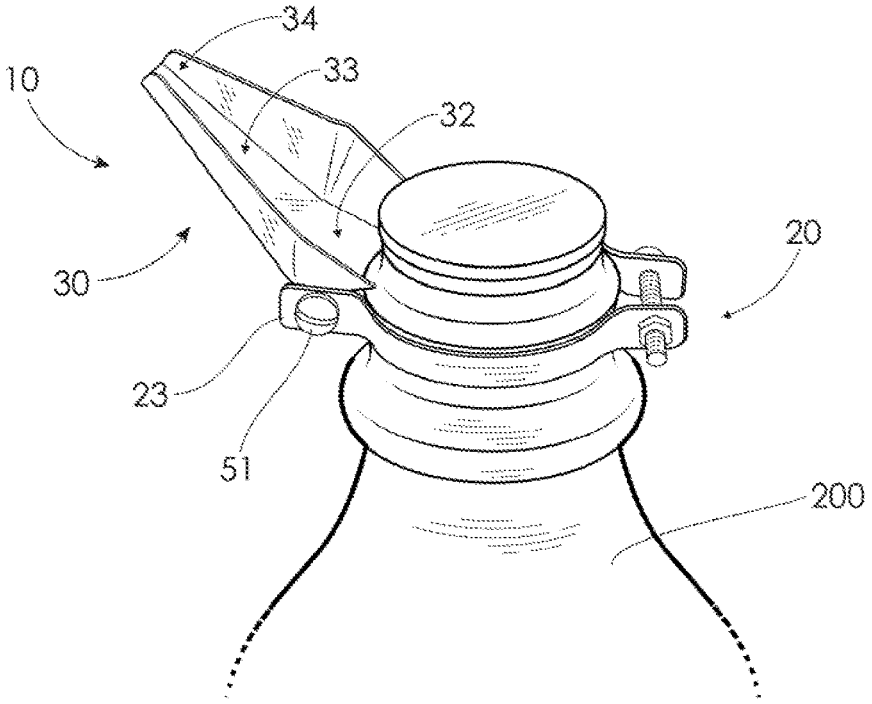
FIG. 1 is a side perspective view of a pourer device in accordance with a preferred embodiment of the present invention attached to a mouth portion of a juice bottle, the pourer device shown in the in-use configuration thereof.

It should be noted in the following description that like or the same reference numerals in different embodiments denote the same or similar features.

FIGS. 1 to 5 show a pourer device 10 according to a preferred embodiment of the present invention mounted or installed externally and adjacent to a mouth portion of bottles 200. The bottles 200 shown are a juice bottle (FIGS. 1 to 3) and a milk bottle (FIGS. 4 and 5), however, the invention can be used with any bottle as desired. The bottle 200 as is known includes an upper opening or mouth 202 with a threaded neck 204 for engagement by a closing cap 206.

The pourer device 10 comprises a mount portion 20 and a guide chute 30.

The guide chute 30 comprises a generally channel shaped body having a wider proximal entry portion 32 adjacent the bottle neck 204 and a main portion 33 which converges to a narrower distal portion 34. The main portion 33 includes a central section 35 with side walls 36 extending upwardly from side edges thereof to define the channel shaped body. The main portion 33 is shaped such that the side walls 36 converge towards each other to the distal portion 34. The proximal portion 32 is shaped as an entry portion and is angled upwardly relative to the main portion 33. The angled entry portion 32 positions the main portion 33 at the optimal angle for pouring in use, which in the embodiment is at about 45°. The entry portion 32 also includes a curved edge 37 which substantially matches the curve of the bottle neck 204.

Figure 2:
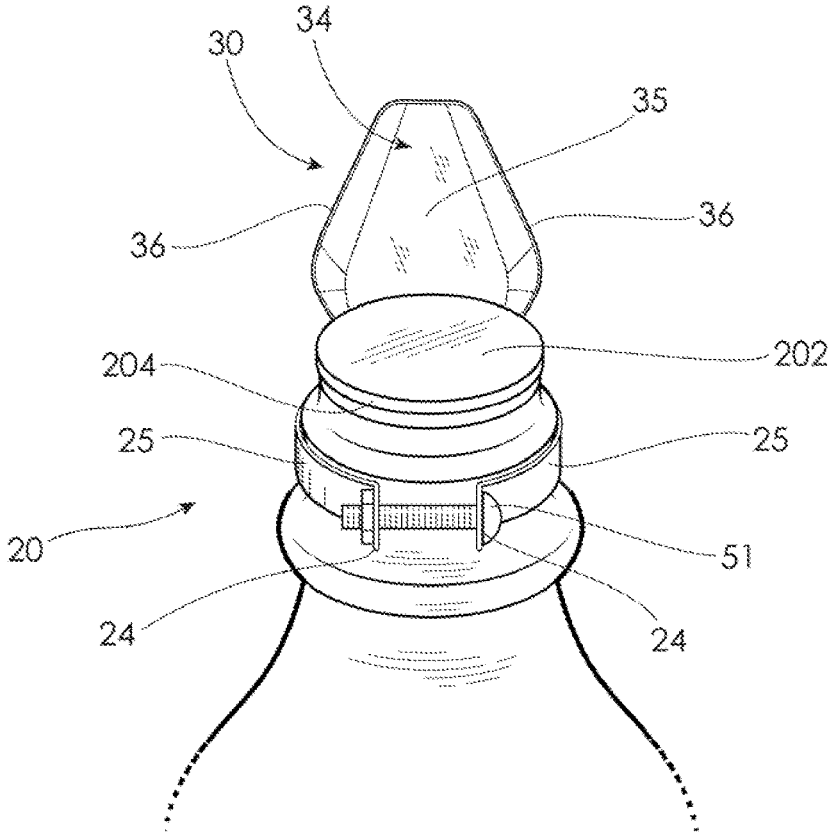
FIG. 2 is a rear perspective view of FIG. 1.
Figure 3:
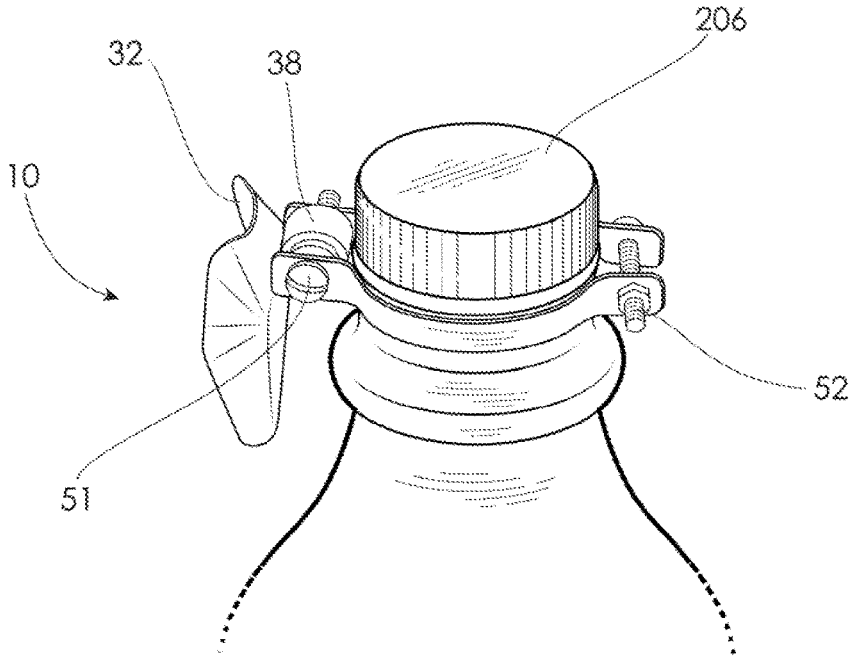
FIG. 3 is a side perspective view corresponding to FIG. 1, but with the pourer device in the storage configuration thereof.
Figure 4:
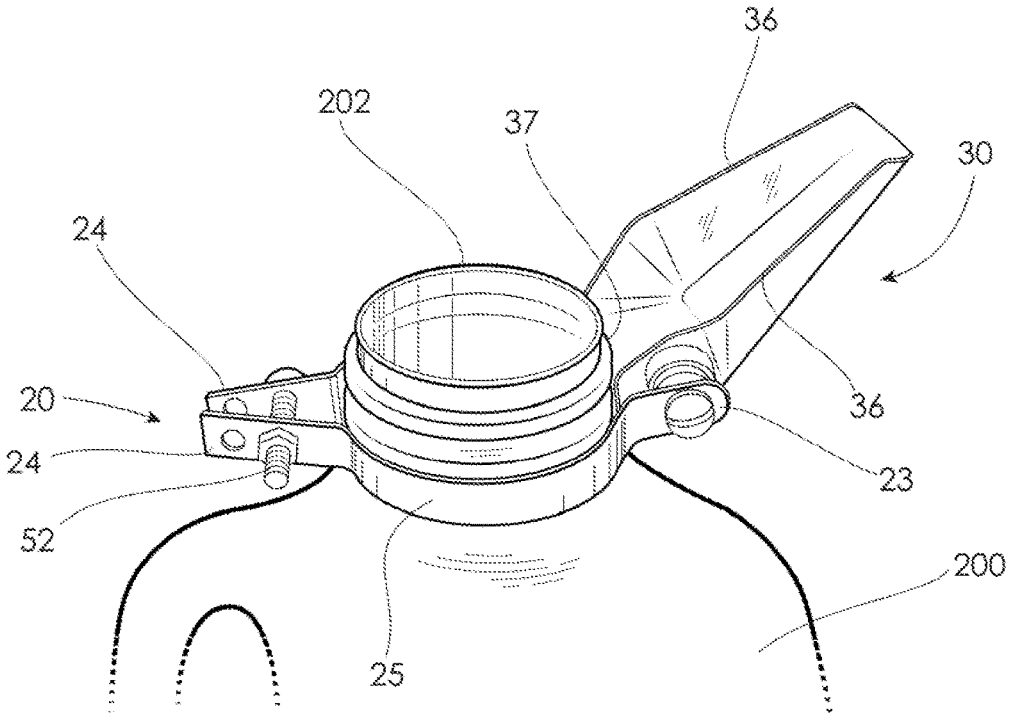
FIG. 4 is a side perspective view of the pourer device attached to the mouth portion of a milk bottle, the pourer device in the in-use configuration thereof.
Figure 5:
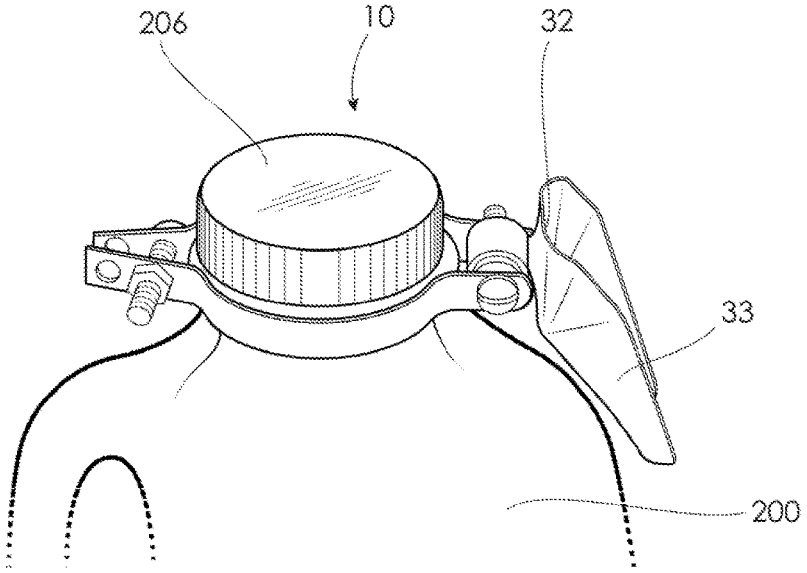
FIG. 5 is a side perspective view of FIG. 4 with the pourer device in the storage configuration thereof.

The guide chute 30 comprises a pivot mount 38 at a lower surface thereof which is attached to the mount portion 20. The pivot mount 38 allows the guide chute 30 to be moved from a storage configuration as shown in FIGS. 3 and 5 at which the main portion 33 is generally downward and away from the neck 204, to an in-use configuration as shown in FIGS. 1, 2 and 5 at which the main portion 33 is positioned to receive liquid from the bottle and to guide or essentially funnel the liquid to a container as desired.

The mount portion 20 comprises two generally half ring portions each having a first end tab 23, a second end tab 24, and a curved midsection 25 therebetween. The pivot mount 38 of the guide chute 30 is disposed between the first end tabs 23, and a first fastener 51 extends through and connects the first end tabs 23 to the pivot mount 38. The curved midsections 25 are for extending around opposing side portions of the bottle neck 204. The second end tabs 24 meet at an opposite side of the bottle neck 204 to the first end tabs 23, and the second end tabs 24 are attached to each other via a suitable second fastener 52.

The mount portion 20 thus allows the device 10 to be mounted to the neck 204 of any bottle and be removable therefrom and mounted to another bottle as needed. The mount portion 20 is attached below the threaded portion of the bottle neck 204 and thus the closing cap 206 can be used to close the bottle 200 as needed with the pourer device attached thereto.

Movement of the guide chute 30 between the in-use and storage configurations can be via a friction fit provided by the first fastener 51 or a ratchet or other locking configuration to maintain the guide chute 30 in the in-use configuration as needed.

The device 10 in use receives poured liquid flow from the opening 202 of a bottle 200 and directs or shapes the liquid flow to a finer or narrower flow due to the converging shape of the guide chute 30. Thus allows a user to more easily direct the liquid being poured from a bottle to avoid spillage and wastage. The device 10 is particularly useful for large volume liquid bottles such as juice, milk, and other liquids such as oil. Such liquids for example can be poured into smaller volume containers such as sports bottles, cups, glasses or any other container as needed.

The pourer device 10 can also be used for solids which can be poured, such as sugar, salt, flour and other granular material.

Whilst preferred embodiments of the present invention have been described, it will be apparent to skilled persons that modifications can be made to the embodiments described. For example, the guide chute 30 can be shaped in other forms, and can be wider if desired. The side walls can also be higher in height if needed. The guide chute can also be formed as a funnel.

The mount portion can also be formed in other ways, such as a quick mountable clip. For example, the half ring portions 21 can be made to be resilient to provide a spring like grip effect, at which they can be made to temporarily separate and then spring back together to grip the neck of the bottle. This embodiment may remove the need for the second fastener 52.

As shown, the mount portion is also adjustable to fit bottle necks of different sizes.

The mount portion can also include a sealing means for sealing with the neck of the bottle. The sealing means can be rubber sections for example to avoid any leakage of liquids between the mount portion and the bottle.

The guide chute can also be curved to have a concave shape.

The in-use angle between the mount portion and the guide chute is also preferably adjustable.

Figure 6:
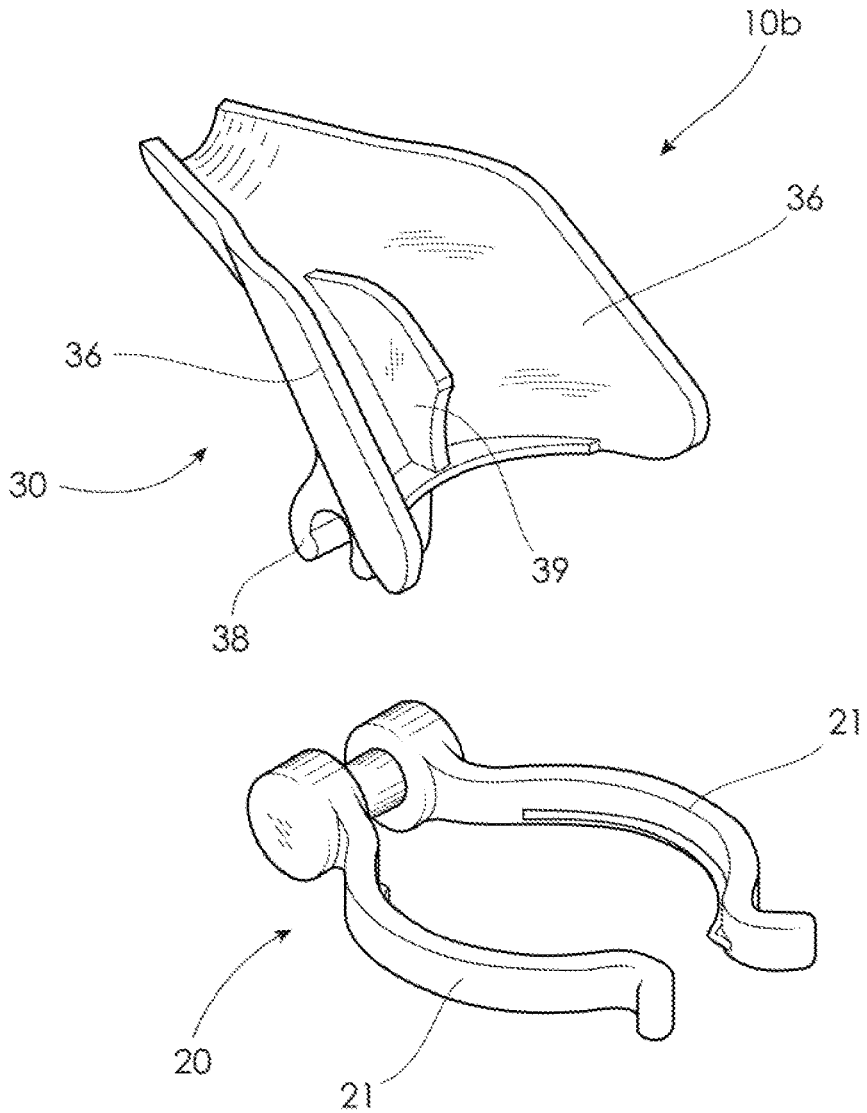
FIG. 6 is an exploded perspective view of a pourer device in accordance with another preferred embodiment of the present invention.
Figure 7:
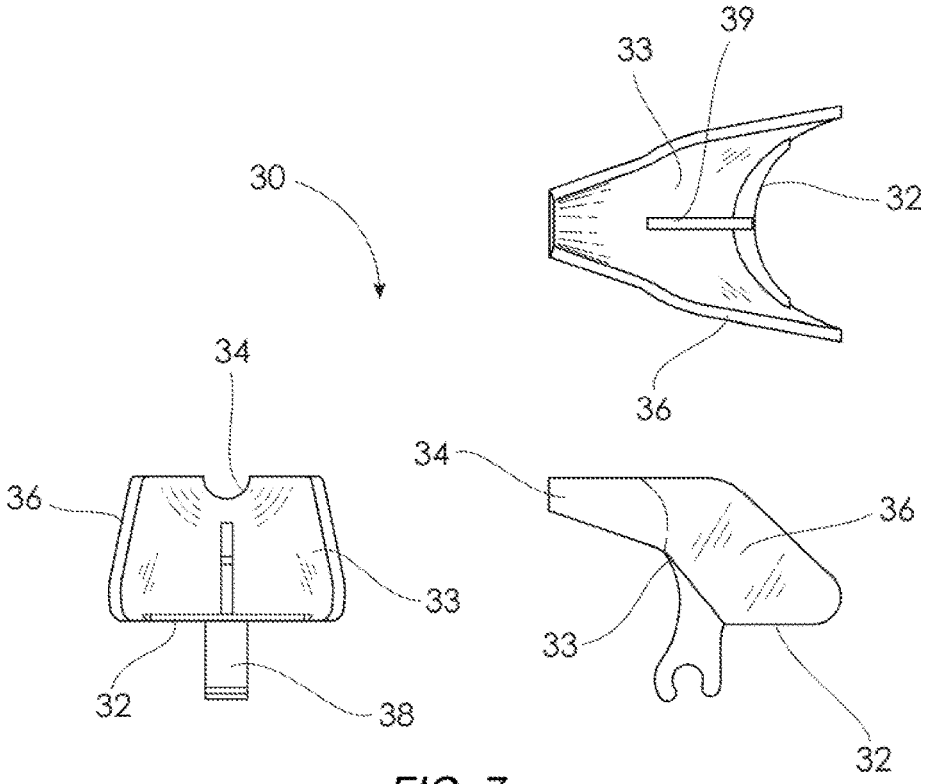
FIG. 7 shows top plan, front elevation, and side elevation view of the guide chute of the pourer device of FIG. 6.
Figure 8:
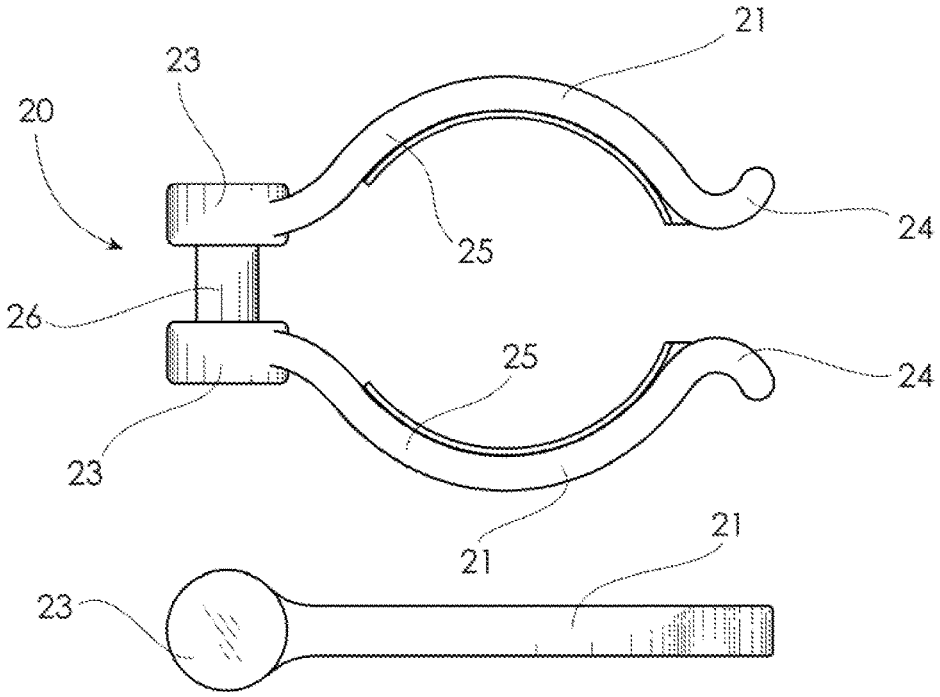
FIG. 8 shows top plan and side elevation views of the mount portion of the pourer device of FIG. 6.

FIGS. 6 to 8 show a pourer device 10*b* according to another preferred embodiment of the present invention. The pourer device 10*b* also comprises a mount portion 20 and a guide chute 30.

The guide chute 30 also comprises a generally channel shaped body having a wider proximal entry portion 32, a central main portion 33, and a narrower distal portion 34. The body converges from the entry portion 32 to the distal portion 34 and has side walls 36 extending upwardly from side edges thereof to define the channel shaped body. The central main portion 33 include a central baffle fin 39 oriented towards the distal portion 34. The distal portion 34 is shaped as a spout opening.

The proximal portion 32 is shaped as an entry portion and is angled towards the top surface of the central main portion 33. The angled entry portion 32 positions the main portion 33 at the optimal angle for pouring in use, which in the embodiment is at about 45°. The entry portion 32 also includes a curved edge 37 which substantially matches the curve of the bottle neck 204. The distal portion 34 is angled way from the top surface of the main portion by an angle of about 45°. This positions the distal portion as a downwardly directed spout in use.

The guide chute 30 also comprises a pivot mount 38 at a lower surface thereof which is pivotably attachable to the mount portion 20. The pivot mount 38 allows the guide chute 30 to be moved from a storage configuration at which the main portion 33 is generally downward and away from the neck 204, to an in-use configuration at which the main portion 33 is positioned to receive liquid poured from the bottle and to guide or essentially funnel the liquid to a container as desired.

The mount portion 20 comprises two generally half ring portions 21 each having a first end tab 23, a second end tab 24, and a curved midsection 25 therebetween. The pivot mount 38 of the guide chute 30 is connected to a connector 26 between the first end tabs 23. The curved midsections 25 are for extending around opposing side portions of the bottle neck 204. The second end tabs 24 are shaped to be pushed onto the neck of a bottle. The mount portion is formed as a quick mountable clip. The half ring portions 21 are resilient to provide a spring like grip effect, at which they can be made to temporarily separate and then spring back together to grip the neck of the bottle.

The mount portion 20 thus allows the device 10 to be mounted to the neck 204 of any bottle and be removable therefrom and mounted to another bottle as needed. The mount portion 20 is attached below the threaded portion of the bottle neck 204 and thus the closing cap 206 can be used to close the bottle 200 as needed with the pourer device attached thereto.

The device 10 in use receives poured liquid flow from the opening 202 of a bottle 200 and directs or shapes the liquid flow to a finer or narrower flow due to the converging shape of the guide chute 30.

I claim:

1. A pourer device for a bottle having a neck which defines a bottle opening, the pourer device comprising:

a mount portion for detachable attachment to an external surface of a bottle, and a guide chute mounted to the mount portion and disposed in use to receive liquid flow from the bottle opening, the guide chute shaping liquid flow from the bottle opening into a narrower flow, wherein the guide chute comprises a pivot mount at a lower surface, said pivot mount being attached to the mount portion.

2. The pourer device of claim 1, wherein the mount portion mounts to the neck of the bottle.

3. The pourer device of claim 1, wherein the guide chute comprises a body having a shape selected from a group consisting of a generally channel shape and funnel shape.

4. The pourer device of claim 3, wherein the guide chute further comprises a wide entry portion and a main portion converging to a narrow distal portion.

5. The pourer device of claim 4, wherein said main portion is comprised of a central section with side walls extending upwardly from side edges thereof to define the body.

6. The pourer device of claim 5, wherein the entry portion is angled upwardly relative to said main portion.

7. The pourer device of claim 6, wherein the entry portion positions the main portion at an angle of about 45° in use.

8. The pourer device of claim 7, wherein the entry portion comprises a curved edge matching a curve of the bottle neck.

9. The pourer device of claim 1, wherein said pivot mount allows the guide chute to be moved from a storage configuration to an in-use configuration.

10. The pourer device of claim 9, wherein the pivot mount locks the guide chute in the in-use configuration.

11. The pourer device of claim 1, wherein the mount portion comprises two generally half ring portions, each half ring portion having one end thereof attached to the mount portion, a second end thereof attachable to each other, and a midsection therebetween disposed on opposite sides of the bottle neck.

12. The pourer device of claim 11, wherein each midsection is curved.

13. The pourer device of claim 1, wherein the mount portion comprises a quick mountable clip.

14. The pourer device of claim 1, wherein the mount portion comprises sealing means for the bottle.

15. The pourer device of claim 5, wherein the central section comprises a baffle fin.

16. The pourer device of claim 4, wherein the distal portion is angled away from the main portion.

17. A pourer device for a bottle having a neck which defines a bottle opening, the pourer device comprising:

a mount portion for detachable attachment to an external surface of a bottle, and a guide chute mounted to the mount portion and disposed in use to receive liquid flow from the bottle opening, the guide chute shaping liquid flow from the bottle opening into a narrower flow, wherein the mount portion comprises resilient members.

18. A pourer device for a bottle having a neck which defines a bottle opening, the pourer device comprising:

a mount portion for detachable attachment to an external surface of a bottle, and a guide chute mounted to the mount portion and disposed in use to receive liquid flow from the bottle opening, the guide chute shaping liquid flow from the bottle opening into a narrower flow, wherein an in-use angle between the mount portion and the guide chute is adjustable.

* * * * *